US005293937A

United States Patent [19]

Schultz et al.

[11] Patent Number: 5,293,937

[45] Date of Patent: Mar. 15, 1994

[54] ACOUSTIC SYSTEM AND METHOD FOR PERFORMING OPERATIONS IN A WELL

[75] Inventors: Roger L. Schultz, Richardson; Ricky M. Holloman, Lewisville, both of Tex.

[73] Assignee: Halliburton Company, Duncan, Okla.

[21] Appl. No.: 977,309

[22] Filed: Nov. 13, 1992

[51] Int. Cl.[5] ..... E01B 43/00

[52] U.S. Cl. ..... 166/250

[58] Field of Search ..... 166/250, 65.1, 66; 175/40, 46, 48, 50

[56] References Cited

U.S. PATENT DOCUMENTS

| | | | |
|---|---|---|---|
| Re. 29,734 | 8/1978 | Manning | 340/18 NC |
| 2,285,809 | 6/1942 | Davis | 250/83.6 |
| 2,352,833 | 7/1944 | Hassler | 73/51 |
| 2,421,423 | 6/1947 | Krasnow | 250/83 |
| 2,425,868 | 8/1947 | Dillon | 177/352 |
| 2,547,875 | 4/1951 | Krasnow | 73/359 |
| 2,607,221 | 8/1952 | Babson et al. | 73/155 |
| 2,677,790 | 5/1954 | Arps | 324/1 |
| 2,810,546 | 10/1957 | Eaton et al. | 255/1 |
| 3,015,801 | 1/1962 | Kalbfell | 340/18 |
| 3,205,477 | 9/1965 | Kalbfell | 340/18 |
| 3,233,674 | 2/1966 | Leutwyler | 166/63 |
| 3,588,804 | 6/1971 | Fort | 340/18 |
| 3,659,259 | 4/1972 | Chaney, Jr. et al. | 340/18 |
| 3,789,355 | 1/1974 | Patton | 340/18 LD |
| 3,790,930 | 2/1974 | Lamel et al. | 340/18 NC |
| 3,800,277 | 3/1974 | Patton et al. | 340/18 LD |
| 3,820,063 | 6/1974 | Sexton et al. | 340/18 LD |
| 3,821,696 | 6/1974 | Harrell et al. | 340/18 LD |
| 3,831,138 | 8/1974 | Rammner | 340/18 LD |
| 3,863,203 | 1/1975 | Patton et al. | 340/18 LD |
| 3,876,016 | 4/1975 | Stinson | 175/45 |
| 3,886,495 | 5/1975 | Sexton et al. | 340/18 LD |
| 3,900,827 | 8/1975 | Lamel et al. | 340/18 NC |
| 3,906,434 | 9/1975 | Lamel et al. | 340/18 NC |
| 3,906,435 | 9/1975 | Lamel et al. | 340/18 NC |
| 3,908,453 | 9/1975 | Jeter | 73/151 |
| 3,930,220 | 12/1975 | Shawhan | 340/18 FM |
| 3,932,836 | 1/1976 | Harrell | 340/18 LD |
| 3,961,308 | 6/1976 | Parker | 340/18 NC |
| 3,971,317 | 7/1976 | Gemmell et al. | 102/21 |
| 3,991,850 | 11/1976 | Escaron | 181/102 |
| 3,997,867 | 12/1976 | Claycomb | 340/18 NC |
| 4,001,773 | 1/1977 | Lamel et al. | 340/18 LD |
| 4,001,775 | 1/1977 | Sexton et al. | 340/18 LD |
| 4,015,234 | 3/1977 | Krebs | 340/18 NC |
| 4,021,773 | 5/1977 | Keenan | 340/18 LD |
| 4,031,826 | 6/1977 | Gemmell et al. | 102/20 |
| 4,038,632 | 7/1977 | Parker | 340/18 NC |
| 4,066,995 | 1/1978 | Matthews | 340/18 LD |
| 4,073,341 | 2/1978 | Parker | 166/65 R |
| 4,100,528 | 7/1978 | Bernard et al. | 340/18 LD |
| 4,103,281 | 7/1978 | Strom et al. | 340/18 LD |
| 4,129,184 | 12/1978 | Parker | 166/315 |
| 4,139,836 | 2/1979 | Chaney et al. | 340/18 NC |
| 4,156,229 | 5/1979 | Shawhan | 340/18 P |
| 4,157,659 | 6/1979 | Murdock | 73/151 |
| 4,166,979 | 9/1979 | Waggener | 325/321 |
| 4,215,425 | 7/1980 | Waggener | 367/83 |
| 4,215,426 | 7/1980 | Klatt | 367/83 |
| 4,215,427 | 7/1980 | Waggener et al. | 367/83 |
| 4,227,405 | 10/1980 | West | 73/151 |
| 4,293,936 | 10/1981 | Cox et al. | 367/82 |
| 4,293,937 | 10/1981 | Sharp et al. | 367/82 |
| 4,298,970 | 11/1981 | Shawhan et al. | 367/82 |
| 4,302,826 | 11/1981 | Kent et al. | 367/82 |
| 4,314,365 | 2/1982 | Petersen et al. | 367/82 |
| 4,320,473 | 3/1982 | Smither et al. | 367/82 |
| 4,367,794 | 1/1983 | Bednar et al. | 166/65 R |
| 4,373,582 | 2/1983 | Bednar et al. | 166/65 R |
| 4,375,239 | 3/1983 | Barrington et al. | 166/336 |
| 4,378,850 | 4/1983 | Barrington | 166/373 |
| 4,390,975 | 6/1983 | Shawhan | 367/82 |
| 4,468,665 | 8/1984 | Thawley et al. | 340/856 |
| 4,562,559 | 12/1985 | Sharp et al. | 367/82 |

(List continued on next page.)

*Primary Examiner*—Thuy M. Bui

*Attorney, Agent, or Firm*—E. Harrison Gilbert, III; Tracy W. Druce

[57] ABSTRACT

A system for performing operations in an oil or gas well (such as flow testing) can operate a plurality of downhole apparatus via one downhole acoustic receiver and one controller or via one downhole acoustic receiver and a respective controller for each downhole apparatus or via one acoustically actuated downhole apparatus sending an acoustic control signal to another downhole apparatus. A corresponding method is also disclosed.

12 Claims, 7 Drawing Sheets

U.S. PATENT DOCUMENTS

| | | | |
|---|---|---|---|
| 4,597,067 | 6/1986 | Bockhorst et al. | 367/82 |
| 4,633,952 | 1/1987 | Ringgenberg | 166/336 |
| 4,660,638 | 4/1987 | Yates, Jr. | 166/250 |
| 4,667,736 | 5/1987 | Rumbaugh et al. | 166/65.1 |
| 4,698,794 | 10/1987 | Kruger et al. | 367/83 |
| 4,711,305 | 12/1987 | Ringgenberg | 166/336 |
| 4,712,613 | 12/1987 | Nieuwstad | 166/53 |
| 4,788,545 | 11/1988 | Farque | 340/856 |
| 4,796,699 | 1/1989 | Upchurch | 166/250 |
| 4,856,595 | 8/1989 | Upchurch | 166/374 |
| 4,862,426 | 8/1989 | Cassity et al. | 367/81 |
| 4,866,607 | 9/1989 | Anderson et al. | 364/422 |
| 4,896,722 | 1/1990 | Upchurch | 166/250 |
| 4,897,646 | 1/1990 | Goodwill et al. | 340/853 |
| 4,908,804 | 3/1990 | Rorden | 367/81 |
| 4,915,168 | 4/1990 | Upchurch | 166/250 |
| 4,954,998 | 9/1990 | Rector | 367/82 |
| 4,971,160 | 11/1990 | Upchurch | 175/4.54 |
| 4,992,997 | 2/1991 | Bseisu | 367/82 |
| 5,005,666 | 4/1991 | Fairborn | 181/102 |
| 5,050,132 | 9/1991 | Duckworth | 367/82 |
| 5,056,067 | 10/1991 | Drumheller | 367/82 |
| 5,101,907 | 4/1992 | Schultz et al. | 166/386 |
| 5,106,727 | 5/1991 | Wittrisch | 166/250 X |
| 5,189,415 | 2/1993 | Shimada et al. | 166/250 X |

ACOUSTIC SYSTEM AND METHOD FOR PERFORMING OPERATIONS IN A WELL

BACKGROUND OF THE INVENTION

This invention relates to an acoustic system and method for performing operations, such as flow testing, in an oil or gas well. These operations are performed using a plurality of downhole devices controlled by one or more controllers responsive to one or more acoustic receivers.

After an oil or gas well has been drilled, a drill stem test is typically performed to check the pressure in the well under flow and shut-in conditions. This provides information relevant to deciding whether to complete the well for producing oil or gas from one or more formations intersected by the well. A similar production test is sometimes performed on a well that has been completed and put on production.

A formation tester valve and a circulating valve are devices typically used to conduct a drill stem or production test. The tester valve is repeatedly opened and closed to allow and prevent oil or gas flow from the well so that the pressure in the well can be checked under such flow and shut-in conditions. A downhole recorder or gauge can record the data for transmission to or retrieval at the surface. After the desired cycling of the tester valve has been completed, the circulating valve is opened to allow fluid to be circulated between the surface and downhole.

Typically these valves do not need to be operated until they are at a desired depth in the well. Thus, there is the need for some way to operate the valves when they are down in the well. Although the valves can be automatically controlled such as by a downhole microprocessor-based controller so that they perform desired operations at predetermined times, tester and circulating valves typically need to perform their functions at times that cannot be predetermined. In this case, there needs to be some way of communicating from the surface a command signal that will initiate or otherwise affect operation of the valves positioned downhole.

This need for surface to downhole communication has been well recognized in the oil and gas industry, and many techniques have been proposed. For example, a flow testing apparatus can be lowered into a well on an electrically conductive cable, known as a wireline, so that electrical signals can be transferred between the surface and the apparatus down in the well. As another example, the flow testing apparatus can be lowered into a well as part of a pipe string which can be mechanically manipulated (reciprocated or rotated) to operate the valves. As a further example, pressure signals can be sent through fluid in the pipe string or in an annulus around the pipe string.

These prior techniques have shortcomings. For example, the wireline and pipe string manipulation techniques call for special sealing requirements at the mouth of the well where the movable wireline or pipe string passes into the well, and the pressure signaling technique requires carefully controlled pump operation at the surface and exerts additional pressure on the downhole environment. These shortcomings are especially significant in a subsea well where the mouth of the well is on the ocean floor. Using mechanical manipulation, it also is difficult to determine how much weight is being applied to obtain the desired mechanical response. In pressure signaling, the condition of the well fluid providing the transmission medium is important because if it degrades, the pressure signals applied at the mouth of the well will be weak, obscure or non-existent downhole where the pressureresponsive receiver is. All of these techniques require a significant surface disturbance, which decreases the safety of the overall operation.

Because of at least these shortcomings of the aforementioned previously proposed flow testing systems and methods, there is the need for an improved system and method that does not have these shortcomings. As more fully disclosed hereinbelow, such an improved system and method should use acoustic technology. Such an improved system and method should allow for multiple downhole apparatus to be selectively controlled via acoustic control signals sent from the surface or from one downhole apparatus to another.

SUMMARY OF THE INVENTION

The present invention overcomes the above-noted and other shortcomings of the prior art by providing a novel and improved acoustic system and method for performing operations in an oil or gas well. Individual downhole tools can be selectively operated, and in a preferred embodiment one downhole apparatus can send one or more acoustic control signals to another downhole apparatus. Although in its broader aspects the acoustic transmission can be through any downhole medium, the preferred medium is a fluid column. Use of the present invention does not require any adverse physical disturbance at the mouth of the well; specifically, neither movement of a wireline or of a tubing string nor increase in fluid pressure from surface pumps is required during acoustic communication.

The present invention provides a remotely controlled tool string for an oil or gas well, comprising: a plurality of working apparatus; an acoustic receiver, including means for responding to an acoustic signal transmitted in the well; and an integrated circuit controller connected to the working apparatus and the acoustic receiver, the integrated circuit controller including means for determining when the acoustic receiver responds to at least one acoustic signal and means for controlling the operation of the working apparatus in response thereto.

The present invention provides a remotely controlled tool string for an oil or gas well, comprising: a plurality of working apparatus, each of the working apparatus including a respective integrated circuit controller; and an acoustic receiver connected to the integrated circuit controllers, the acoustic receiver including means for responding to at least one acoustic signal and providing control signals to the integrated circuit controllers in response thereto.

The present invention provides a remotely controlled tool string for an oil or gas well, comprising a plurality of working apparatus, each including: a respective acoustic receiver responsive to a respective predetermined acoustic control signal, and a respective controller responsive to the respective acoustic receiver; at least one of the working apparatus further including an acoustic transmitter responsive to the controller of the respective working apparatus; and wherein the controller of the at least one working apparatus includes means for actuating the acoustic transmitter to transmit the respective predetermined acoustic control signal to the acoustic receiver of another working apparatus.

The present invention provides a method of performing operations in an oil or gas well wherein a tool string is disposed, the tool string comprising: a first apparatus including a first acoustic receiver, a first controller responsive to the first acoustic receiver, and an acoustic transmitter responsive to the first controller; and a second apparatus including a second acoustic receiver and a second controller responsive to the second acoustic receiver, the method comprising: transmitting a first acoustic control signal to which the first acoustic receiver is responsive; actuating the first controller in response to the first acoustic receiver responding to the first acoustic control signal; operating the acoustic transmitter with the actuated first controller to transmit a second acoustic control signal to which the second acoustic receiver is responsive; and actuating the second controller in response to the second acoustic receiver responding to the second acoustic control signal.

Therefore, from the foregoing, it is a general object of the present invention to provide a novel and improved acoustic system and method for performing operations in an oil or gas well. Other and further objects, features and advantages of the present invention will be readily apparent to those skilled in the art when the following description of the preferred embodiments is read in conjunction with the accompanying drawings.

DETAILED DESCRIPTION OF PREFERRED EMBODIMENTS

General Environment of the Present Invention

During the course of drilling an oil or gas well, the borehole is filled with a fluid known as drilling fluid or drilling mud. One of the purposes of this drilling fluid is to contain in intersected formations any formation fluid which may be found there. To contain these formation fluids, the drilling mud is weighted with various additives so that the hydrostatic pressure of the mud at the formation depth is sufficient to maintain the formation fluid within the formation without allowing it to escape into the borehole. Drilling fluids and formation fluids can all be generally referred to as well fluids.

When it is desired to test the production capabilities of the formation after drilling has stopped, a string of interconnected pipe sections and downhole tools referred to as a test string is lowered into the borehole to the formation depth and the formation fluid is allowed to flow into the string in a controlled testing program.

Sometimes, lower pressure is maintained in the interior of the test string as it is lowered into the borehole. This is usually done by keeping a formation tester valve in the closed position near the lower end of the test string. When the testing depth is reached, a packer is set to seal the borehole, thus closing the formation from the hydrostatic pressure of the drilling (or other) fluid in the well annulus above the packer. The formation tester valve at the lower end of the test string is then opened and the formation fluid, free from the restraining pressure of the drilling fluid, can flow into the interior of the test string.

At other times, the conditions are such that it is desirable to fill the test string above the formation tester valve with liquid as the test string is lowered into the well. This may be for the purpose of equalizing the hydrostatic pressure head across the walls of the test string to prevent inward collapse of the pipe and/or this may be for the purpose of permitting pressure testing of the test string as it is lowered into the well.

The well testing program includes intervals of formation flow and intervals when the formation is closed in. Pressure recordings are taken throughout the program for later analysis to determine the production capability of the formation. If desired, a sample of the formation fluid may be caught in a suitable sample chamber.

At the end of the well testing program, a circulating valve in the test string is opened, formation fluid in the testing string is circulated out, the packer is released, and the test string is withdrawn.

Figure 1:
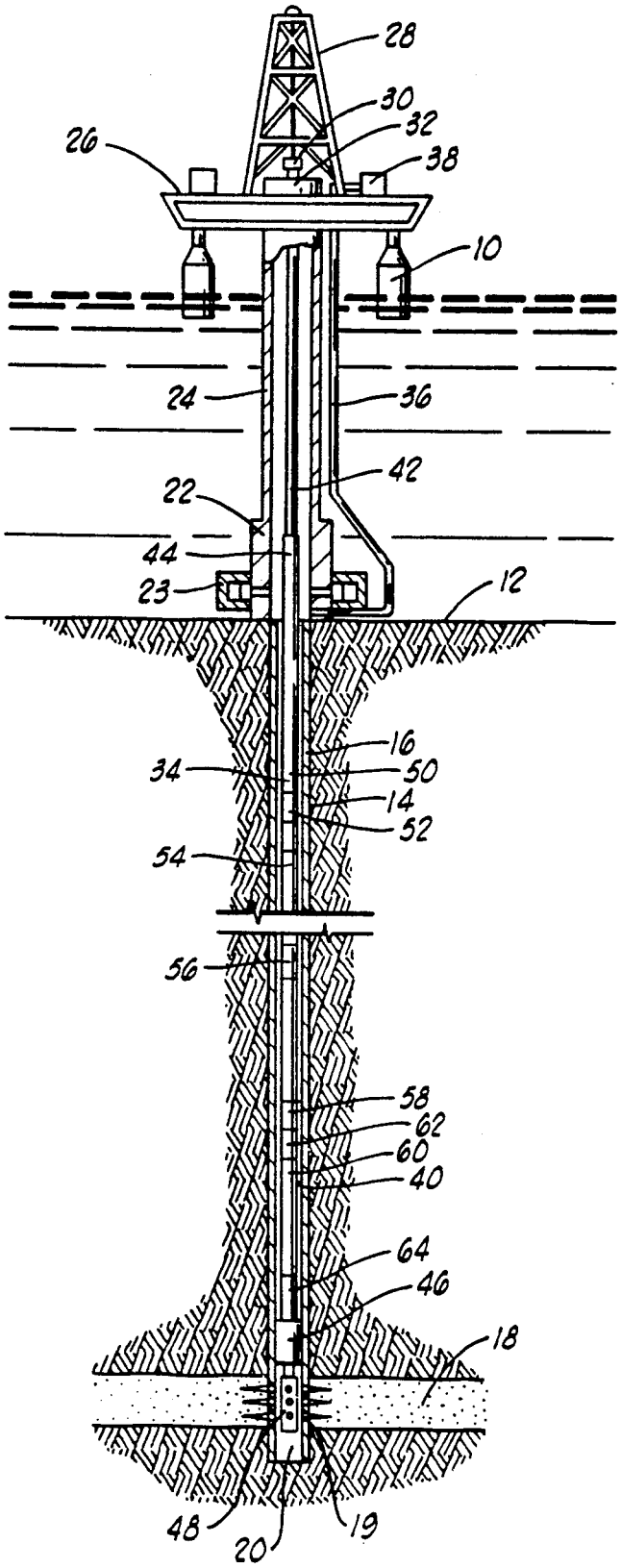
FIG. 1 is a schematic elevational view of a prior type of well test string disposed in a subsea oil or gas well.

A typical arrangement for conducting a drill stem test offshore is shown in FIG. 1. The present invention may also be used on wells located on shore and for production testing (same as a drill stem test only after the well has been completed for production).

The arrangement of the offshore system includes a floating work station 10 stationed over a submerged well site 12. The well comprises a well bore 14, which typically but not necessarily is lined with a casing string 16 extending from the submerged well site 12 to a subterranean formation 18.

The casing string 16 includes a plurality of perforations 19 at its lower end. These provide communication between the formation 18 and a lower interior zone or annulus 20 of the well bore 14.

At the submerged well site 12 is located the wellhead installation 22 which includes blowout preventer mechanisms 23. A marine conductor 24 extends from the wellhead installation 22 to the floating work station 10. The floating work station 10 includes a work deck 26 which supports a derrick 28. The derrick 28 supports a hoisting means 30. A wellhead closure 32 is provided at the upper end of the marine conductor 24. The wellhead closure 32 allows for lowering into the marine conductor 24 and into the well bore 14 a formation test string 34 which is raised and lowered in the well by the hoisting means 30. The test string 34 may also generally be referred to as a tubing string or a tool string.

A supply conductor 36 is provided which extends from a hydraulic pump 38 on the deck 26 of the floating station 10 and extends to the wellhead installation 22 at a point below the blowout preventer 23 to allow the pressurizing of a well annulus 40 defined between the test string 34 and the well bore 14 or the casing 16 if present.

The test string 34 includes an upper conduit string portion 42 extending from the work deck 26 to the wellhead installation 22. A subsea test tree 44 is located at the lower end of the upper conduit string 42 and is landed in the wellhead installation 22.

The lower portion of the formation test string 34 extends from the test tree 44 to the formation 18. A packer mechanism 46 isolates the formation 18 from the fluids in the well annulus 40. Thus, an interior or tubing string bore of the tubing string 34 is isolated from the upper well annulus 40 above packer 46 unless other communication openings are provided. Also, the upper well annulus 40 above packer 46 is isolated from the lower well zone 20 which is often referred to as the rat hole 20.

A perforated tail piece 48 provided at the lower end of the test string 34 allows fluid communication between the formation 18 and the interior of the tubular formation test string 34.

The lower portion of the formation test string 34 further includes intermediate conduit portion 50 and a torque transmitting pressure and volume balanced slip joint means 52. An intermediate conduit portion 54 is provided for imparting packer setting weight to the packer mechanism 46 at the lower end of the string.

It is many times desirable to place near the lower end of the test string 34 a circulating valve 56. Below circulating valve 56 there may be located a combination sampler valve section and reverse circulating valve 58.

Also near the lower end of the formation test string 34 is located a formation tester valve 60. Immediately above the formation testing valve 60 there may be located a drill pipe tester valve 62.

A pressure recording device 64 is located below the formation tester valve 60. The pressure recording device 64 is preferably one which provides a full opening passageway through the center of the pressure recorder to provide a full opening passageway through the entire length of the formation testing string.

Systems

The foregoing describes a general environment for conducting downhole flow tests in an oil or gas well and is germane to the present invention; however, the present invention is particularly adapted for use in deep wells where the testing is to occur at least 5,000 feet below the surface through which the mouth of the well is formed. Attenuation of an acoustic signal transmitted into a well is an exponential function, and below 5,000 feet the calculated attenuation is in a region of particularly fast decay.

Not only is acoustic signal attenuation great at such depths due simply to distance, but also attenuation can be exacerbated by the deteriorating nature of the column of substantially static fluid in the annulus between the test string and the well bore or casing. Although the column itself is static as opposed to the flowing or moving column encountered in MWD work, the liquid and solid components or constituents in the static column tend to separate (thus the "substantially static" nature of the fluid). This deterioration is particularly significant below 5,000 feet and especially below 10,000 feet where temperatures can be at least 325°-350° F. At such depths and temperatures, at least a lower section of the static column can "cook out" wherein the fluid at least begins to gel and thereby cause changed acoustic transmission characteristics that tend to attenuate acoustic signals more significantly. This is an ongoing and changing problem which particularly affects flow tests that are performed over several days (e.g., 5-10 days).

Additionally, the size of the downhole equipment used in the present invention is of small diameter. By this is meant that the tubing or pipe and tool body nominal diameters are not greater than about five inches. Such small diameters are necessitated by the depths to which they are run. This is an important characteristic of the preferred embodiments of the present invention because it is more difficult to generate and transmit acoustic signals within an environment having these small dimensions as compared to generating and transmitting acoustic signals in a shorter, wider tubing or pipe string assembly.

It is to this particular environment that the following systems especially relate.

Figure 2:
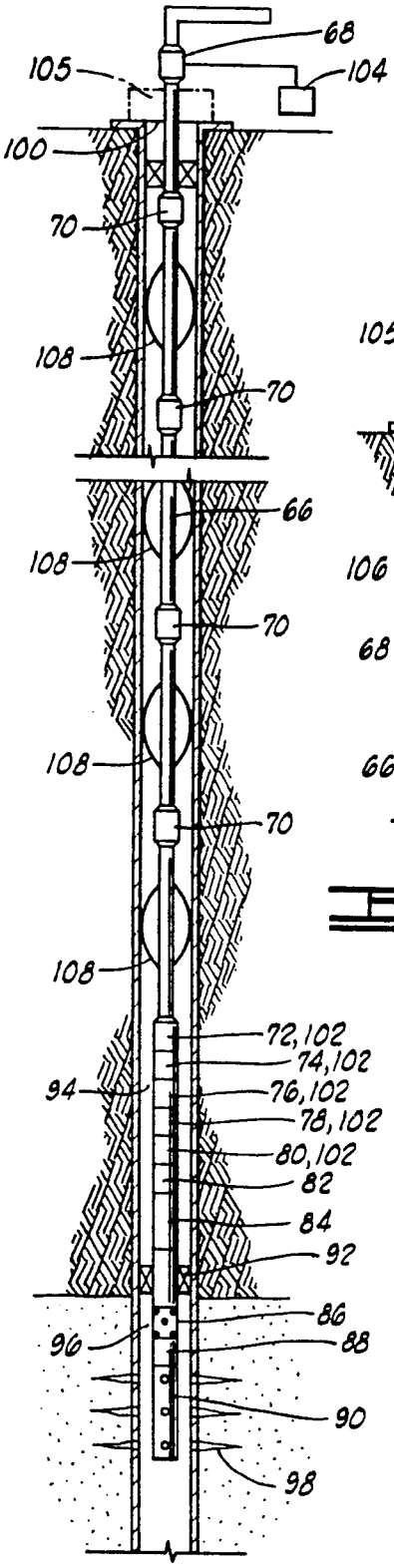
FIG. 2 is a schematic elevational view of a preferred embodiment system for flow testing an oil or gas well of the present invention.

FIG. 2 shows a test string 66 positioned in a deep well. This figure shows a system which uses tubing or drill pipe in the string 66 as the acoustic transmission line. Connected into the string 66 are a master acoustic transmitter 68, a plurality of acoustic repeaters 70, a safety/circulating valve 72, a circulating valve 74 (preferably a recloseable type), a tester valve 76, a downhole data gathering tool 78, a sampler valve 80, a bypass tool 82, a safety joint 84, a flow sub 86, a firing head 88 and perforating guns 90. A retrievable packer 92 separates the well into an upper portion, having an annulus 94 containing the column of substantially static fluid that is present in the well during a flow test, and a lower portion 96, where perforations 98 are typically formed as described with regard to FIG. 1 and where the formation pressure to be tested is expressed since the lower portion 96 intersects the formation having a fluid (hopefully oil or gas) under pressure. In the preferred embodiment, the lower portion 96 begins at least about 5,000 feet below a mouth 100 of the well. The aforementioned components can, individually, be conventional elements known in the art. As to the packer 92, it can also be a semi-permanent type such as used in a well which has been completed for production and in which a production flow test may be conducted.

In the present invention, control signals are to be communicated to the tools comprising at least one or more of the circulating valve 74, the tester valve 76 and the downhole data gathering tool 78. Each tool to be controlled has its own acoustic receiver 102 in the preferred embodiment. These tools to be controlled and their respective acoustic receivers are also disposed at least about 5,000 feet below the mouth 100 of the well because these tools are typically placed near the packer 92 at the lower end of the upper portion of the well. In the preferred embodiment, each of the tools responds to its own specific acoustic signal, so individual tools may be controlled independently of the other tools.

The following definitions are used herein and in the claims. An "acoustic transmitter" is a known device that converts a control signal of any suitable type (e.g., electrical, mechanical, etc.) into energy that creates an acoustic signal in the transmission medium (e.g., the test string 66 in FIG. 2). An "acoustic repeater" is a known device that converts a received acoustic signal into energy that regenerates or retransmits an acoustic signal in the transmission medium. An "acoustic receiver" is a known device that converts a received acoustic signal into another form of signal (e.g., electrical, mechanical, etc.) for causing a downhole tool to be operated or not operated as desired.

Acoustic signals are transmitted from the acoustic transmitter 68 under control of a surface controller 104. For example, the transmitter 68 can be any conventional device (e.g., a piezoelectric stack) which physically bangs the tubing or pipe of the string 66 to generate an acoustic signal.

Initial transmission can occur in one of two ways. The acoustic signal can be generated above the mouth 100 of the well so that it propagates through wellhead equipment 105, such as a blowout preventer, to an acoustic repeater 70 located at the mouth 100 of the well just below the wellhead equipment (e.g., just below the surface blowout preventer rams and the packing). The repeater is needed at this high location in the well because of the significant attenuation through the wellhead equipment. This is the embodiment illustrated in FIG. 2.

Figure 2A:
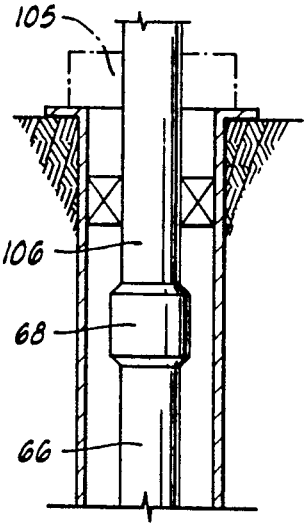
FIG. 2A is a schematic elevational view of an upper portion of an alternative FIG. 2 embodiment having an acoustic isolation sub and an acoustic transmitter connected at the top of a test string.

Alternatively, the test string 66 is suspended at the surface using a special sub 106 which acoustically isolates the acoustic transmission part of the test string 66 from the wellhead equipment 105 (FIG. 2A). The purpose of this isolation sub 106 is to reduce the amount of loss in the acoustical signal through the wellhead equipment, and it can also block unwanted noise signals that may be generated at the surface from entering the string 66 from above the sub 106. The isolation sub 106 may be part of the master transmitter 68, or it may be a separate piece of equipment.

The acoustic repeaters 70 are placed in the test string 66 to amplify or relay the acoustic signals which are being transmitted down the string. The use of the repeaters is necessary when well conditions (depth, mud, pressure, etc.) cause the attenuation of the acoustic signal to be so high that the signal is damped out before reaching the ultimate acoustic receiver 102 to which it is being sent. This is generally the case in the particular environment to which the present invention is especially directed. Each repeater 70 has its own receiver 70*a* and transmitter 70*b* (FIG. 6) which are acoustically isolated to ensure proper reception and retransmission of an acoustic signal. That is, the repeater receiver 70*a* receives the acoustic signal transmitted from the master transmitter 68 or an upstream repeater (which received signal has been attenuated along its travel down the test string 66), and the repeater transmitter 70*b* regenerates the received attenuated acoustic signal and transmits further down the test string 66 the regeneration of the received acoustic signal.

To further isolate the test string 66 from signal losses, centralizers 108 (FIG. 2) designed for acoustic isolation are run at regular intervals along the test string 66. Suitable acoustic centralizers are known in the art.

Figure 6:
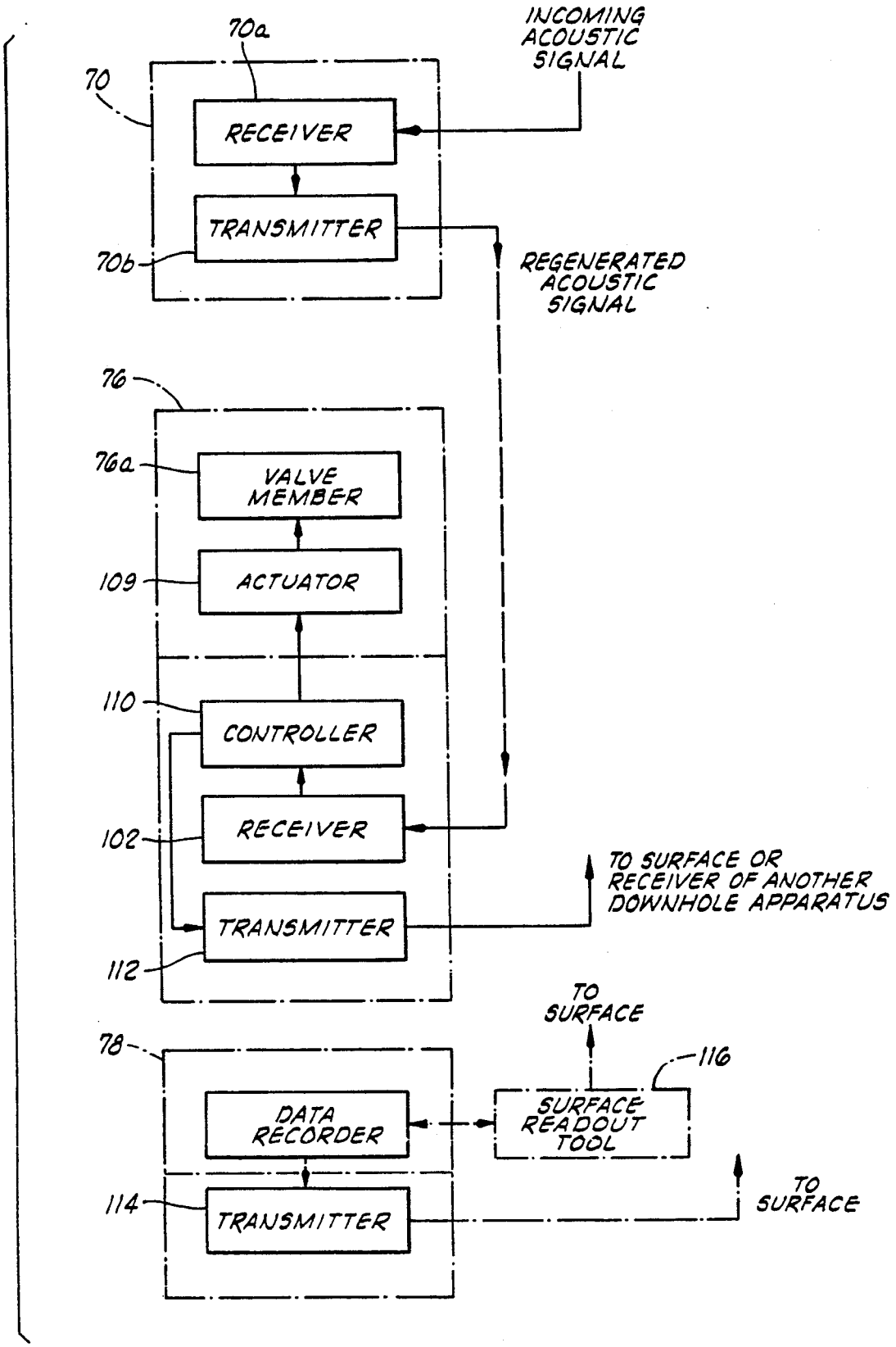
FIG. 6 is a block diagram of downhole control and signal transmission elements of the present invention.

Referring to FIG. 6, various force producing operating or actuating means 109, including hydraulic, electronic and mechanical, may be used to make the valve member of a selected valve (e.g., valve member 76*a* of tester valve 76 depicted in FIG. 6) function in response to the acoustical signals. These are preferably worked by downhole control means for generating electrical signals for controlling the opening and closing of the valves. Such a downhole controller 110 can be microprocessor-based and programmed to respond to a connected acoustic receiver 102 in the respective valve tool receiving an acoustic command signal from the transmitter 68 and the repeaters 70. This type of integrated circuit controller is programmed and connected to determine when the connected acoustic receiver 102 responds to at least one acoustic signal and to control the operation of connected working apparatus in response thereto. Alternatively, the receiver 102 or the controller 110 can be in separate tools and other types of integrated circuit controllers can be used (e.g., discrete combinational logic, programmable logic arrays, etc.).

Figure 7:
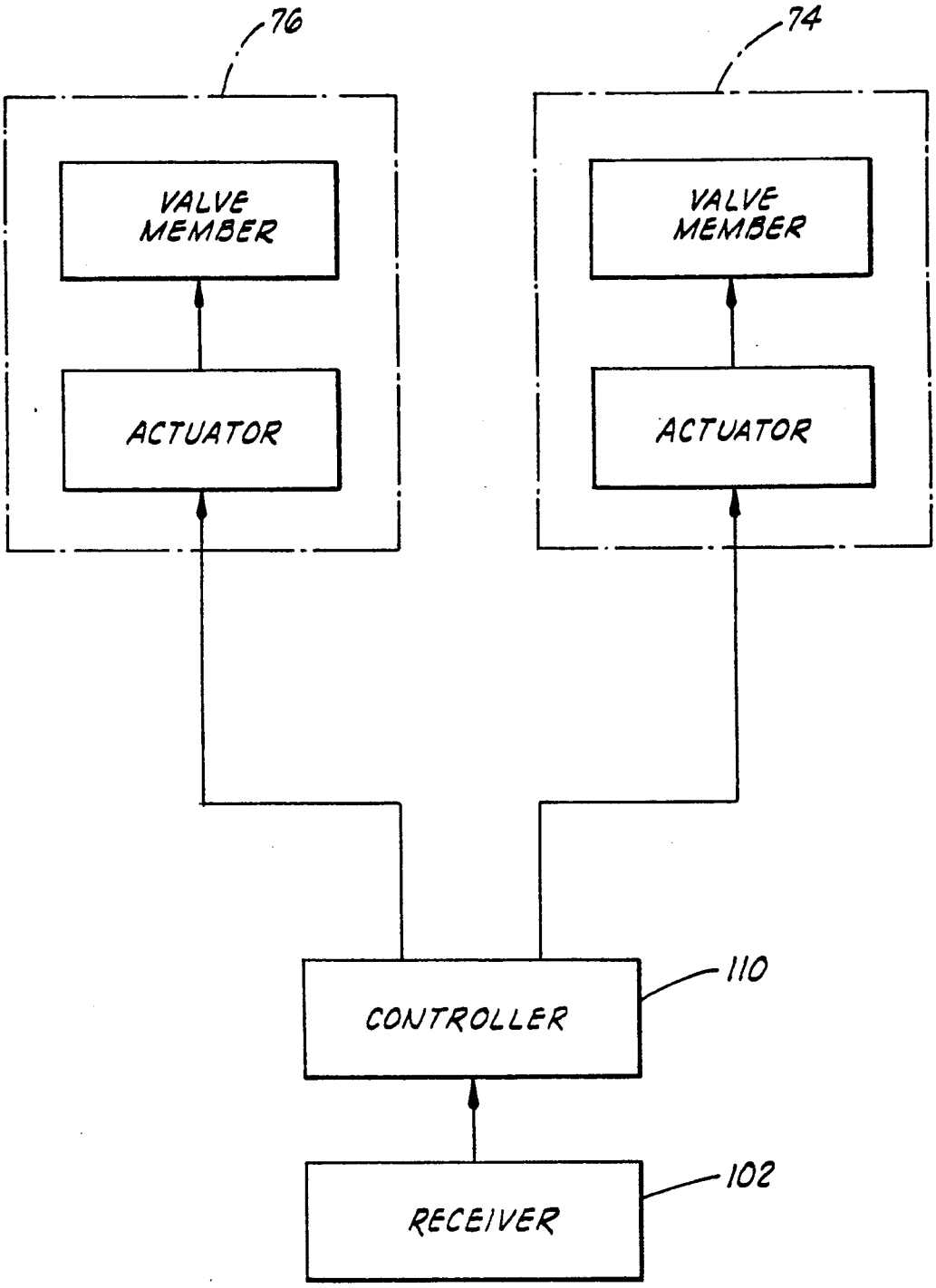
FIG. 7 is a block diagram of one downhole acoustic receiver and one downhole controller controlling multiple downhole working apparatus.

The downhole control means 110 can include means for sequentially generating a plurality of predetermined flow test event control signals in response to the associated acoustic receiver 102 receiving an appropriate acoustic command signal. The downhole control means 110 can alternatively include means for generating a first electrical signal for the respective valve in response to the acoustic receiver 102 receiving the acoustic signal having a first encoding and for generating a second control signal for the respective valve in response to the acoustic receiver receiving the acoustic signal having a second encoding different from the first encoding. Furthermore, the present invention can be implemented with one acoustic receiver 102 and one downhole control means 110 which function together to control different actuating means for respective ones of the valves. Referring to FIG. 7, a single controller 110, connected to a single acoustic receiver 102, the tester valve 76 and the circulating valve 74 and responsive to the acoustic receiver 102 receiving an appropriately encoded acoustic signal, generates control signals for the tester valve and the circulating valve to open and close the tester valve in the well and to at least open the circulating valve in the well.

The valves that are to be controllable via acoustic signaling are preferably equipped with acoustic transmitters 112 (FIG. 6) so they can send acoustic signals back to the surface to indicate their status or other information. To receive such signals at the surface, the primary acoustic transmitter 68 can be combined with or used with an acoustic receiver (not separately shown). This feature also allows one tool to control another tool if it is instructed or programmed to do so.

The downhole data gathering tool 78 is used to monitor and record any wellbore parameter which is present in the well including pressure, temperature, flow rate, bubble point, density, etc. This data can then be immediately transmitted to the surface using an acoustic transmitter 114 (FIG. 6), or the data can be stored and then transmitted to the surface later. This feature is very useful because it eliminates the need for conventional methods of retrieving downhole data such as electric line or gauge retrieval; however, conventional methods of retrieving can also be used in the present invention. For example, data can be retrieved by lowering a surface readout tool 116 into the well on a wireline, latching onto the downhole gauge 78, and transferring data from the gauge up the wireline and out of the well.

There are various techniques that may be used to send, process and interpret the acoustical data which is being sent using this system. The following three methods may be used to transmit data or signals through the acoustic medium being utilized. All the following techniques apply to any transmitter and any receiver located anywhere in the system, including all surface and subsurface locations in the system.

For sophisticated data transmission, a binary system using one signal state to represent a logic 0 and another signal state to represent a logic 1 may be used. For example, a base frequency may be output from an acoustic transmitter to the rest of the system. When the frequency is increased above the base frequency, this is interpreted by the receiver as a 1. When the frequency is decreased below the base frequency, this is interpreted by the receiver as a 0. In this way any information may be transmitted in the acoustic system as binary data which may be converted to other forms of data or used in the raw form. This is the preferred technique.

Another technique for operating individual valves in the system is to make individual valves respond to individual frequency bands. In this system a transmitter inputs a constant frequency signal into the system. If this frequency is within the frequency band a particular valve is programmed to respond to, the valve will operate. This system can be used in a very low frequency mode, where the number of acoustic shots received within a period of time (for instance 5 minutes) corresponds to a particular valve to be operated.

A combination of signal amplitude and frequency may also be used to signal individual tools. In this way complex signals based on time, amplitude or a combination of both can be used to operate individual tools in the system.

Regardless of the specific signaling technique, and as mentioned above, a respective controller 110 in the system can respond in various ways to a respective acoustic receiver 102 receiving an appropriate acoustic command. For example, the controller 110 can sequentially generate a plurality of control signals in response to the acoustic receiver receiving a single acoustic command signal, or the controller 110 can generate a first control signal for one working apparatus (e.g., the tester valve 76) in response to the acoustic receiver receiving a first acoustic command signal having a first encoding and it can generate a second control signal for another working apparatus (e.g., the circulating valve 74) in response to the acoustic receiver receiving a second acoustic command signal having a second encoding different from the first encoding.

In a typical well test, at least the tester valve 76 needs to be operated. In this case the surface controller 104 (FIG. 2) would be used to make the primary acoustic transmitter 68 send a particular signal down the test string 66. As an acoustic pulse is received by one of the acoustic repeaters 70, the signal is amplified or repeated by the acoustic repeater and sent down the next section of the test string 66. This process is repeated until the signal reaches the ultimate downhole acoustic receiver or receivers 102. This causes the respective controller 110 to operate the respective actuator 109 and thus the selected valve member.

When data is to be sent up the test string to the surface from one of the downhole tools, the system works in the same way, but in reverse. A downhole tool inputs an acoustic signal into the test string. This signal travels up the string to the first acoustic repeater 70 it encounters. The repeater then sends the signal up the next section of the test string 66 to the next repeater. This process is followed until the signal reaches the surface receiver where it is sent to the surface controller 104.

Figure 3:
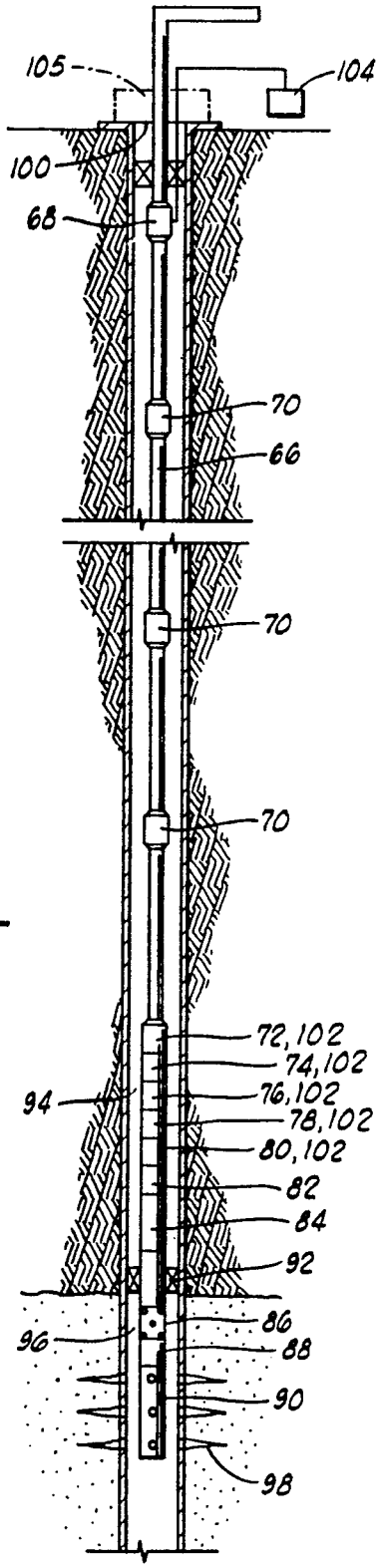
FIG. 3 is a schematic elevational view of another preferred embodiment system for flow testing an oil or gas well of the present invention.
Figure 4:
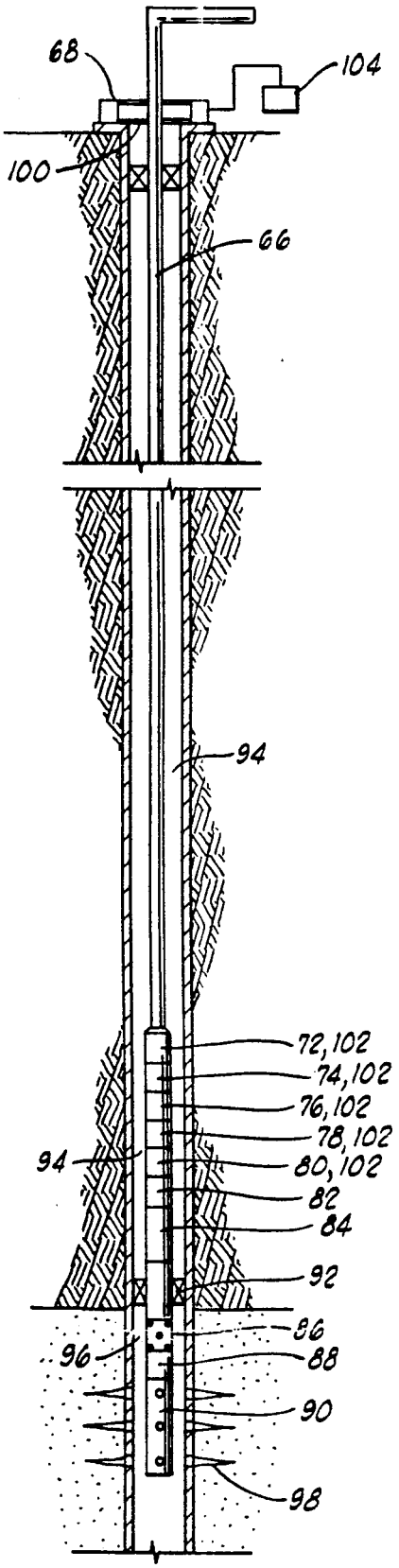
FIG. 4 is a schematic elevational view of a further embodiment system for flow testing an oil or gas well of the present invention.
Figure 5:
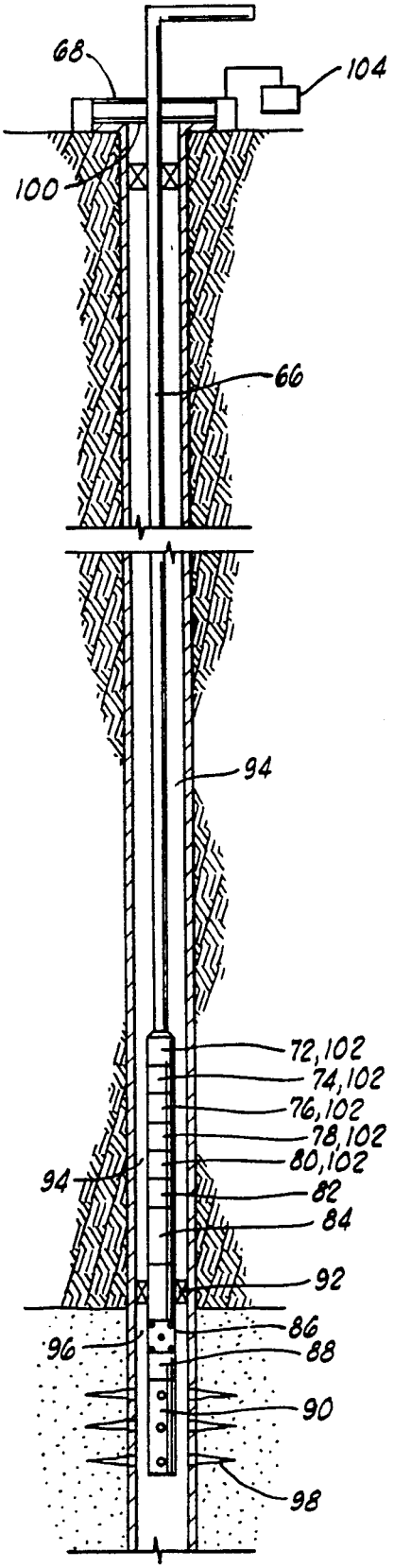
FIG. 5 is a schematic elevational view of a still further embodiment system for flow testing an oil or gas well of the present invention.

The other embodiments shown in FIGS. 3–5 include the same components as those shown in FIG. 2 at least to the extent indicated therein by like reference numerals.

FIG. 3 shows a system wherein the column of annulus or tubing fluid is used as the acoustic transmission media. This is the most preferred embodiment of the present invention, and the annular fluid embodiment is preferred over the tubing fluid embodiment. Variations of annulus pressure, fluid, etc. may be used to change or enhance the acoustic transmission characteristics of the fluid column which is being used to transmit the acoustic signals. In this system an acoustic signal is imparted to the fluid by one of the transmitters in the system. For example, an acoustic command signal can be sent from the acoustic transmitter 68, which is of a type known in the art for inducing acoustic pulses in a fluid column (e.g., a gas gun or explosives). This can also include a transmitter located in one of the downhole tools sending data to the surface or to another downhole tool. The operation of the system, and the function of the individual components is the same for this system as it is for the system of FIG. 2.

With regard to the primary acoustic transmitter 68, it can be placed at the top of the annulus or tubing fluid column below the wellhead equipment 105 depending upon whether the transmission medium is to be the annulus fluid or the tubing fluid; or it can be placed in a pipeline to the wellhead equipment which communicates with the selected fluid column. In the latter, the primary acoustic transmitter 68 generates within fluid outside the well the acoustic signal for commanding downhole functions; this signal is then propagated through the fluid in the surface plumbing, such as including the wellhead equipment 105, into the selected fluid column in the well (i.e., in the annulus or in the tubing string).

FIG. 4 shows a system wherein the well casing is being used as the acoustic transmission medium, and FIG. 5 shows a system wherein the subterranean earth is being used to conduct the acoustic signals. These are not preferred because repeaters cannot be readily used in these embodiments (e.g., too expensive to put them along the casing and too difficult to implant them in the earth), whereby they may not be suitable for communicating to sufficient depths as required for the particular environment to which the present invention is especially directed.

Figure 8:
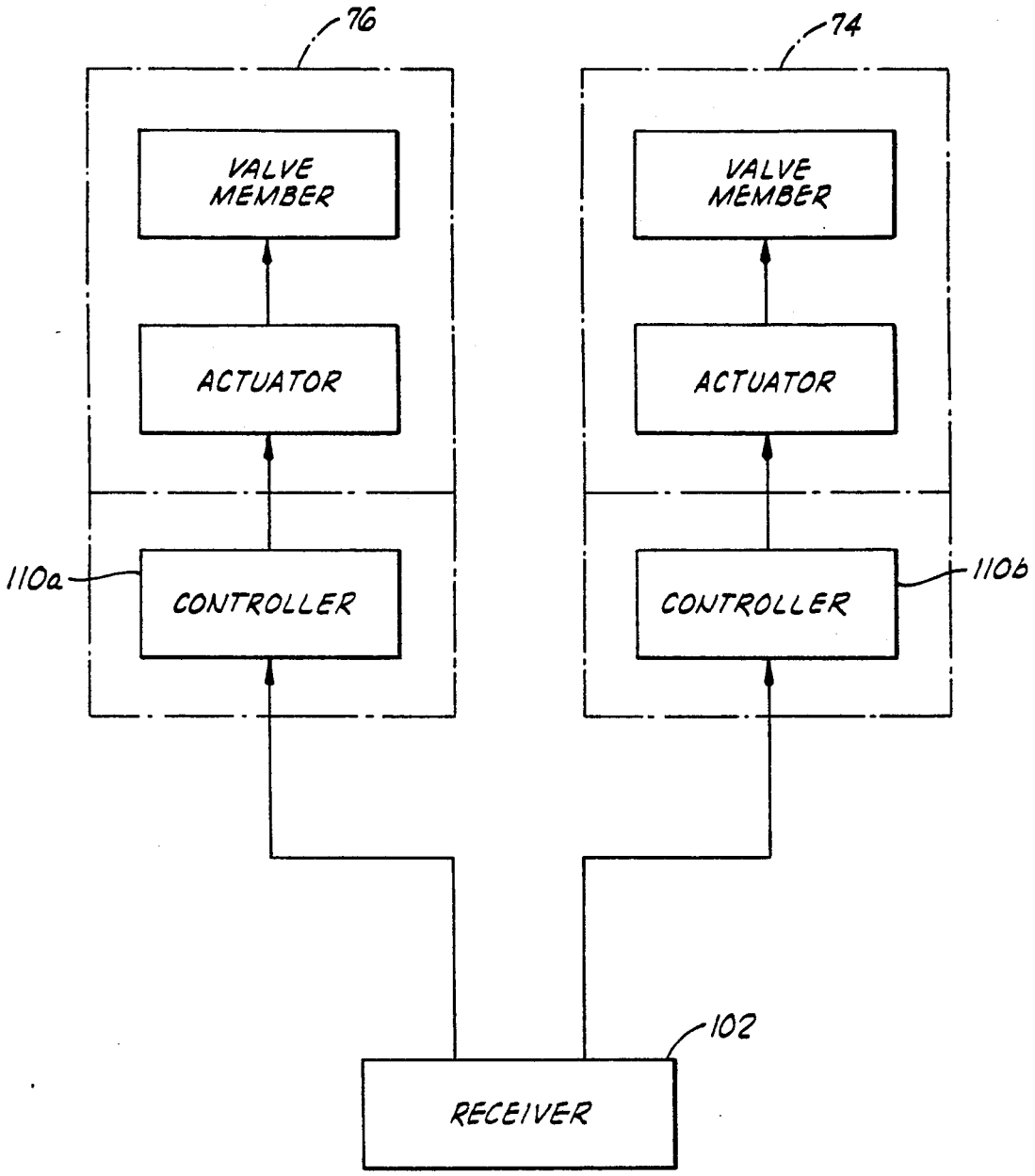
FIG. 8 is a block diagram of one downhole receiver connected to multiple downhole working apparatus, each of which working apparatus has a respective controller.

Referring to FIG. 8, there is shown a configuration of elements that can be used in any of the systems of the present invention described above. In this configuration each of a plurality of working apparatus includes a respective integrated circuit controller, and an acoustic receiver is connected to these integrated circuit controllers so that the acoustic receiver responds to at least one acoustic signal and provides control signals to the integrated circuit controllers in response thereto. As specifically illustrated, one acoustic receiver 102 communicates with two controllers 110*a*, 110*b*, wherein the controller 110*a* is part of the downhole working apparatus containing the tester valve 76 and wherein the controller 100*b* is part of the downhole working apparatus containing the circulating valve 74.

Figure 9:
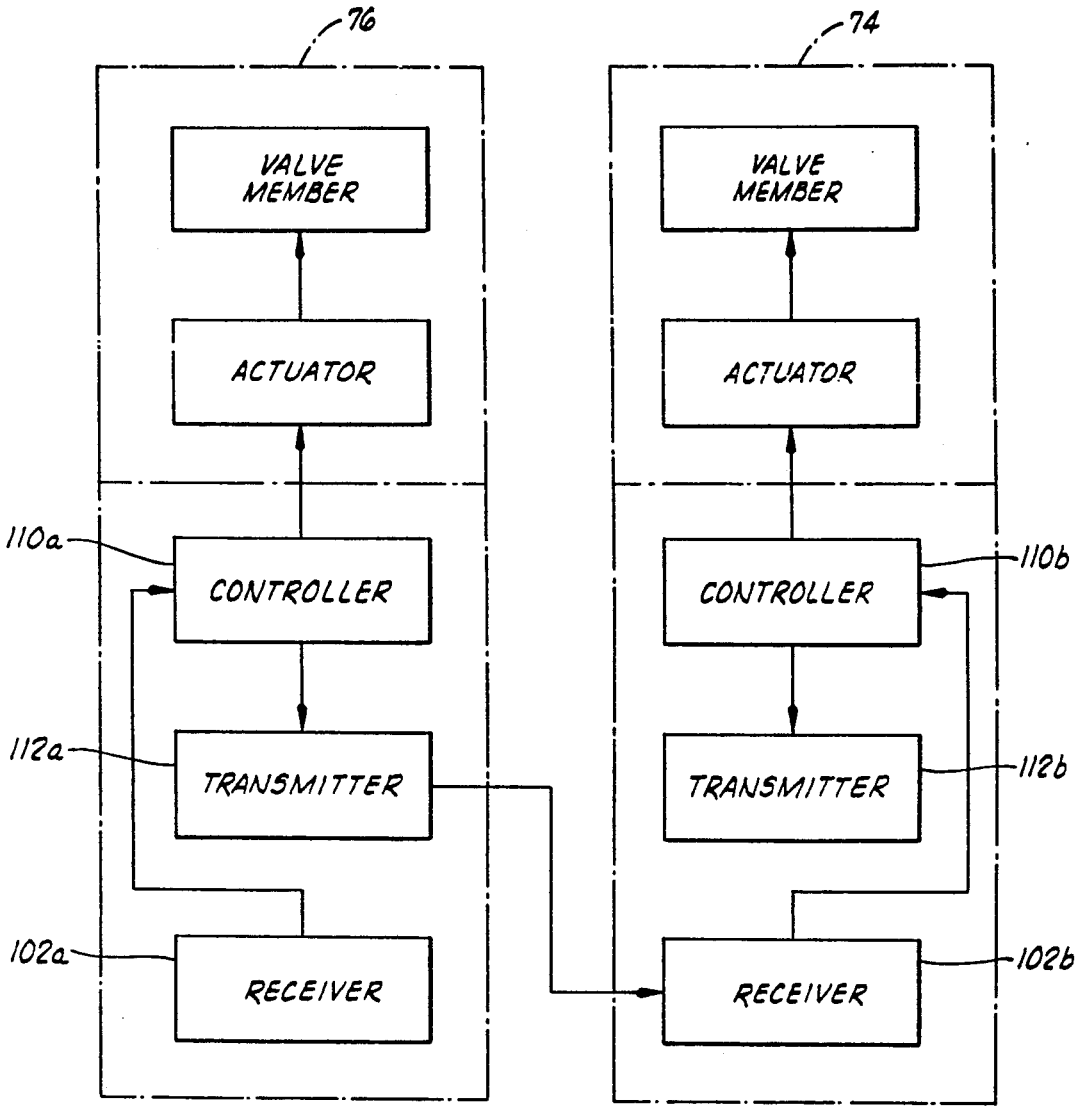
FIG. 9 is a block diagram of multiple downhole working apparatus wherein one operates another.

Referring to FIG. 9, each of a plurality of working apparatus includes a respective acoustic receiver responsive to a respective predetermined acoustic control signal and each further includes a respective controller responsive to the respective acoustic receiver. These can respond to the primary uphole acoustic transmitter that transmits the respective predetermined acoustic control signal to the acoustic receiver of a selected one of the working apparatus. As more particularly shown in FIG. 9, each working apparatus further includes an acoustic transmitter responsive to the controller of the respective working apparatus, and the controller of a first working apparatus includes means for actuating the acoustic transmitter of the first working apparatus to transmit the respective predetermined acoustic control signal to the acoustic receiver of a second working apparatus.

More particularly, associated with the tester valve 76 is the acoustic receiver 102*a*, the controller 110*a* and the acoustic transmitter 112*a*. Associated with the circulating valve 74 is the acoustic receiver 102*b*, the controller 110*b* and the acoustic transmitter 112*b*. The downhole controller 110*a* is disposed with the tester valve 76 so that the downhole controller 110*a* operates the tester valve 76 in response to the acoustic receiver 102*a* receiving the appropriate acoustic command signal and so that the downhole controller 110*a* operates the downhole transmitter 112*a* to transmit the activating signal to the acoustic receiver 102*b*. The downhole controller 110*b* operates the circulating valve 74 in response to the downhole receiver 102*b* receiving the actuating signal from the downhole transmitter 112*a*.

The components for implementing the foregoing systems can be of types known in the art. As to the controller(s) 110, a particular type of preferred integrated circuit implementation can be programmed or otherwise preset using known techniques to define the various means referred to above. For example, a microprocessor-based controller can be programmed to continually monitor a connected acoustic receiver so that when a signal is received (e.g., through a data port or an interrupt input) from the acoustic receiver, the controller will automatically implement preprogramming designed for generating and sending one or more electrical signals out one or more data ports of the controller to operate in a known manner one or more connected downhole devices (e.g., tester valve 76 or transmitter 112). Such pre-programming includes the specific nature that the output signal needs to be, and this specific nature depends on the particular implementation of the controlled downhole device and thus would readily be apparent to one skilled in the art given a particular downhole device. Such pre-programming also defines whether a controller controls only one device or operation thereof, or several devices or several operations of one or more devices, in response to one signal from the connected acoustic receiver. All such programming can be conventionally implemented given the description herein and specific equipment implementations.

Methods

The embodiment of FIG. 9 can be used to perform a method of testing an oil or gas well, comprising: lowering a test string into the well after drilling has stopped, the test string including a plurality of working apparatus each having a respective acoustic receiver responsive to a respective predetermined acoustic control signal and each further having a respective controller responsive to the respective acoustic receiver; transmitting the respective predetermined acoustic control signal for the acoustic receiver of a selected one of the working apparatus; detecting the transmitted acoustic control signal in the acoustic receiver of the selected working apparatus; and actuating the controller of the selected working apparatus in response to detecting the transmitted acoustic control signal so that the actuated controller operates the selected working apparatus. For the FIG. 9 embodiment, each working apparatus further has an acoustic transmitter responsive to the controller of the respective working apparatus and the aforementioned step of actuating the controller also includes the controller operating the acoustic transmitter of the selected working apparatus to transmit the respective predetermined acoustic control signal to the acoustic receiver of another of the working apparatus so that the controller of such other working apparatus is actuated in response to the respective acoustic receiver responding to the signal transmitted from one working apparatus to another. These steps of transmitting, detecting and actuating can be repeated for other selected ones of the working apparatus if there are any.

The present invention also provides a method of flow testing an oil or gas well after the well has been drilled to a depth of at least 5,000 feet. This method should be apparent from the foregoing, but the preferred embodiment is concisely restated here as comprising: (a) after drilling has stopped, creating a column of substantially static acoustic-attenuating fluid in the well, including setting a packer in the well for separating the well into an upper portion and a lower portion, the lower portion beginning at least 5,000 feet below a mouth of the well and intersecting a formation having a fluid under pressure and the upper portion containing the column of substantially static fluid so that fluid in at least a lower section of the column is heated by natural heating in the well to a temperature at which the fluid at least begins to gel; (b) after step (a), transmitting an acoustic command signal from the mouth of the well into the column of fluid, including at least part of the lower section thereof, so that the acoustic command signal is coherently propagated through the column of substantially static acoustic-attenuating, gelling fluid to an acoustic receiver disposed in the well at least as deep as the lower section of the column of fluid; (c) receiving the coherently propagated acoustic command signal in the acoustic receiver and generating in the well at least one control signal in response thereto; and (d) operating a tester valve in response to the at least one control signal, the tester valve disposed in the well at least as deep as the lower section of the column of fluid for controlling the flow of fluid from the lower portion of the well into a tubing string disposed in the well. In the preferred embodiment, the acoustic command signal is regenerated from an acoustic repeater disposed in the tubing string, wherein neither the acoustic repeater nor the tubing string is greater than five inches in diameter. Step (b) preferably includes: (1) acoustically isolating an acoustic transmitter from wellhead equipment at the mouth of the well and actuating the acoustic transmitter to generate the acoustic command signal, or (2) transmitting the acoustic command signal through wellhead equipment at the mouth of the well and regenerating the acoustic command signal through an acoustic repeater disposed at the mouth of the well below the wellhead equipment, or (3) generating the acoustic command signal in a fluid outside the well communicating, such as through wellhead equipment, with the column of fluid in the well.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A system for flow testing an oil or gas well, comprising:

a tester valve;

a circulating valve connected to said tester valve;

acoustic receiver means for receiving an acoustic command signal in the well; and control means, connected to said acoustic receiver means, said tester valve and said circulating valve and responsive to said acoustic receiver means in the well, for generating control signals for said tester valve and said circulating valve to open and close said tester valve in the well and to at least open said circulating valve in the well.

2. A system as defined in claim 1, wherein said control means includes means for sequentially generating a plurality of said control signals in response to said acoustic receiver means receiving a single said acoustic command signal.

3. A system as defined in claim 1, wherein said control means includes means for generating a first said control signal for said tester valve in response to said acoustic receiver means receiving a first said acoustic command signal having a first encoding and for generating a second said control signal for said circulating valve in response to said acoustic receiver means receiving a second said acoustic command signal having a second encoding different from said first encoding.

4. A system as defined in claim 1, wherein said control means includes a single downhole controller having means for controlling said tester valve and said circulating valve in response to said acoustic receiver means receiving said acoustic command signal.

5. A system as defined in claim 1, wherein said control means includes a first downhole controller disposed with said tester valve and a second downhole controller disposed with said circulating valve, said first and second downhole controllers responsive to said acoustic receiver means receiving respective acoustic command signals.

6. A system as defined in claim 1, wherein said control means includes:

downhole transmitter means for transmitting an actuating signal to said circulating valve;

a first downhole controller, disposed with said tester valve so that said first downhole controller operates said tester valve in response to said acoustic receiver means receiving said acoustic command signal and so that said first downhole controller operates said downhole transmitter means for transmitting said actuating signal to said circulating valve;

downhole receiver means, disposed with said circulating valve, for receiving said actuating signal from said downhole transmitter means; and a second downhole controller, disposed with said circulating valve and said downhole receiver means so that said second downhole controller operates said circulating valve in response to said downhole receiver means receiving said actuating signal from said downhole transmitter means.

7. A remotely controlled tool string for an oil or gas well, comprising:

a plurality of working apparatus;

an acoustic receiver, including means for responding to an acoustic signal transmitted in the well; and an integrated circuit controller connected to said working apparatus and said acoustic receiver, said integrated circuit controller including means for determining when said acoustic receiver responds to at least one acoustic signal and means for controlling the operation of said working apparatus in response thereto.

8. A remotely controlled tool string for an oil or gas well, comprising:

a plurality of working apparatus, each of said working apparatus including a respective integrated circuit controller; and an acoustic receiver connected to said integrated circuit controllers, said acoustic receiver including means for responding to at least one acoustic signal and providing control signals to said integrated circuit controllers in response thereto.

9. A remotely controlled tool string for an oil or gas well, comprising a plurality of working apparatus, each including: a respective acoustic receiver responsive to a respective predetermined acoustic control signal, and a respective controller responsive to said respective acoustic receiver; at least one of said working apparatus further including an acoustic transmitter responsive to said controller of the respective said working apparatus; and wherein said controller of said at least one said working apparatus includes means for actuating said acoustic transmitter to transmit the respective predetermined acoustic control signal to said acoustic receiver of another said working apparatus.

10. A system for performing operations in an oil or gas well, comprising:

a first apparatus including a first acoustic receiver, a first controller responsive to said first acoustic receiver, and a first acoustic transmitter responsive to said first controller;

a second apparatus including a second acoustic receiver and a second controller responsive to said second acoustic receiver; and master acoustic transmitter means for transmitting a first control signal to which said first acoustic receiver is responsive so that said first acoustic receiver actuates said first controller to operate said first acoustic transmitter to transmit a second control signal to which said second acoustic receiver is responsive to thereby operate said second controller.

11. A method of performing operations in an oil or gas well wherein a tool string is disposed, the tool string comprising: a first apparatus including a first acoustic receiver, a first controller responsive to the first acoustic receiver, and an acoustic transmitter responsive to the first controller; and a second apparatus including a second acoustic receiver and a second controller responsive to the second acoustic receiver, said method comprising:

transmitting a first acoustic control signal to which the first acoustic receiver is responsive;

actuating the first controller in response to the first acoustic receiver responding to the first acoustic control signal;

operating the acoustic transmitter with the actuated first controller to transmit a second acoustic control signal to which the second acoustic receiver is responsive; and actuating the second controller in response to the second acoustic receiver responding to the second acoustic control signal.

12. A method of testing an oil or gas well, comprising:

lowering a test string into the well after drilling has stopped, the test string including a plurality of working apparatus each comprising: a respective acoustic receiver responsive to a respective predetermined acoustic control signal, a respective controller responsive to the respective acoustic receiver, and a respective acoustic transmitter responsive to the controller of the respective working apparatus;

transmitting the respective predetermined acoustic control signal for the acoustic receiver of a selected one of the working apparatus;

detecting the transmitted acoustic control signal in the acoustic receiver of the selected working apparatus; and actuating the controller of the selected working apparatus in response to said detecting the transmitted acoustic control signal so that the actuated controller operates the selected working apparatus and further so that the actuated controller operates the acoustic transmitter of the selected working apparatus to transmit the respective predetermined acoustic control signal to the acoustic receiver of another of the working apparatus.

* * * * *